United States Patent [19]

Eickelberg

[11] 3,985,496

[45] Oct. 12, 1976

[54] WALKING BEAM DEVICE FOR CONVEYING MATERIALS AT HIGH TEMPERATURE

[76] Inventor: Henry L. Eickelberg, Rte. No. 4, Watertown, Wis. 53094

[22] Filed: Feb. 10, 1975

[21] Appl. No.: 542,596

Related U.S. Application Data

[63] Continuation of Ser. No. 402,605, Oct. 1, 1973, abandoned.

[52] U.S. Cl. ..... 432/122; 432/239

[51] Int. Cl.[2] ..... F27B 9/14

[58] Field of Search ..... 432/122, 123, 126, 239

[56] References Cited

UNITED STATES PATENTS

| | | | |
|---|---|---|---|
| 1,137,711 | 4/1915 | Gottschalk | 432/122 |
| 1,374,132 | 4/1921 | Worth | 432/126 |
| 3,512,628 | 5/1970 | Keough | 432/122 X |
| 3,781,166 | 12/1973 | Bunzel et al. | 432/126 |

*Primary Examiner*—John J. Camby

*Attorney, Agent, or Firm*—Andrus, Sceales, Starke & Sawall

[57] ABSTRACT

A conveyor for a furnace includes a walking beam unit mounted within an elongated opening through the bottom wall. A longitudinally-moving H-shaped support member is located beneath a refractory beam. An expandable tube extends beneath the beam and has a central passageway in the crossbar portion connected in series with the tubular member. Cooling water flows through the expandable tube and the beam passageway. Expansion and contraction of the tube is affected by selectively restricting the exhaust flow of the cooling fluid. An upwardly open channel supports the tube on a roller support to movably mount the beam, tube and channel supports as a unit. A cylinder operator is secured to one end.

11 Claims, 5 Drawing Figures

WALKING BEAM DEVICE FOR CONVEYING MATERIALS AT HIGH TEMPERATURE

BACKGROUND OF THE INVENTION

This application is a continuation application of Ser. No. 402,605 filed on Oct. 1, 1973, now abandoned.

The present invention relates to a walking beam unit for high temperature conveying apparatus and particularly to an improved and simplified walking beam unit for transport of heavy material through a high temperature heating chamber or the like without complicated mechanical alloy actuating systems and with a minimum number of wear points, as well as permitting convenient sealing when desired. Thus, in basic metal industries, the transfer of heavy slabs, billets and the like employ automated conveying apparatus for movement through a treating oven or furnace. Small furnace variations have been devised where in a relatively short walking beam is suspended from the opposite ends and actuated from either or both of the end supports. Such a structure, however, significantly limits the scope and size of the furnace equipment which can be employed and, thus, is applicable only to very specialized application.

Various types of transfer beam structures have further been employed for the transport and handling of heavy metal slabs and the like within high temperature ovens, particularly where protective atmosphere was not required. Generally, the prior art devices for such installation are also complicated with an attendant expense, as well as initial expense. Further, such constructions normally require a high degree of maintenance as a result of the high temperature conditions. Various abrasive materials such as metal oxide, slags or refractory dust which are often encountered in the furnace heating chamber tend to adversely affect the mechanism with further maintenance time and costs. Further, the external drive connections to the internal conveying apparatus have limited the effective sealing of the heating chamber against air infiltration.

For example, totally sealed heating chambers have been suggested. For example, U.S. Pat. No. 3,656,720 which issued Apr. 18, 1972 to Western discloses a floor mounted actuating system with a walking beam unit connected through the front opening of the charge vestibule as well as through openings in the floor of both the heating and cooling chambers. A relatively complicated air infiltration system includes a relatively complicated and highly expendable bellows type seal is provided. Such forms of seal can present an explosion hazard when employed in various forms of combustible protective atmospheres. The danger arises in various forms of seals as it is quite difficult to purge the unit from start-up with the possibility of the presence of an explosive mixture. A walking beam unit in accordance with the present invention simplifies the external seal construction in such applications and may significantly eliminate explosive hazards as the result of permitting a selfcontained beam support.

Generally, sealed furnaces include roller, tray and chain belt type conveyor means to create a continuous moving conveyor mechanism constructed of high temperature alloys. Such components are not only expensive, but in many instances are in limited supply and difficult to obtain. Further, the strength of even high temperature alloys may rapidly decrease with increasing temperatures. Consequently, limited sized loads are transported at the higher temperatures. Push-type transfer mechanisms have also been employed. However, the loading and unloading of non-uniform shaped objects generally presents a problem and special material may demand consideration to insure that the conveyor means does not cause distortion or interconnected welding of complicated shapes and special material loads must be carried or transported with the more costly alloy conveying mechanisms. A further alternative suggested has been a rotary type hearth furnace which can be employed at both high temperatures and under effective fluid type sealed operations. Such devices are not readily adapted to automated loading and unloading.

There is, therefore, a very significant need for a relatively simple mechanism which can be employed in high temperature and/or sealed environments and one which is not unduely subject to wear.

SUMMARY OF PRESENT INVENTION

The present invention is particularly directed to an improved walking beam unit particularly adapted for incorporation into and as a part of a high temperature conveying apparatus for mounting within the lower portion of a furnace structure. Generally, in accordance with the present invention, the conveying mechanism includes an elongated beam means which is extended through a base opening in the high temperature environment. A longitudinally moving support member is located beneath the beam means in combination with a fluid-activated expandable means located between the beams and the support means. The expandable means is collapsible to hold the beam means below the supporting level of the base wall. When supplied with a suitable pressurized fluid medium, it establishes a lifting force to raise the beam vertically above such base wall. The support means moves longitudinally to effect movement of the raised beam and the load. The total system can be actuated in a simple, reliable manner. The separation of the beam support from the furnace chamber proper, particularly adapts the unit to use in high temperature environments.

In a further novel aspect of the present invention particularly relating to such high temperature environments, the expandable means may form a cooling fluid channel member which is connected for cooling of the system. In a particular aspect of this aspect of the invention, an elongated, expandable tubular member extends throughout the beam means which has a passageway in the lower portion or underside thereof connected in series with the tubular member. Cooling water or other similar medium flows through the expandable tubular member and the beam cooling passageway. Expansion and contraction of the expandable member is conveniently affected by restricting the exhaust flow of the cooling fluid for increasing the pressure within the expandable means while maintaining an appropriate flow of cooling medium. Applicant has found that the walking beam unit constructed in accordance with the present invention may be readily incorporated into high temperature oven including sealed furnaces without the necessity of complicated external seals while permitting the transport of heavy materials. The necessity for high temperature alloys is significantly eliminated and the temperature and load conditions are essentially limited by the strength of the supporting refractory material of the beam and the structural strength of the undersupporting structure as calculated at normal room temperature. Thus, more particularly, the improved walking beam readily permits conveying of loads at temperatures above 1600° in a sealed chamber.

More particularly, in accordance with a preferred and unique instruction of the present invention, the furnace structure is formed with the conventional internal lining to define an elongated heating chamber. The base wall includes one or more longitudinally extended beam support openings. Within each such opening, a novel walking beam unit of the present invention is located including an upper supporting member, preferably formed of a high temperature refractory material, supported within a channel shaped structural beam element. The beam element rests on an expandable element which extends throughout the length of the opening and preferably includes a downwardly opening channel section which telescoped over an upwardly opening channel support. The expandable tube member is located within the opening defined by the opposing sections. The bottom channel section is supported on a suitable roller support or the like. By expanding of the tube member, the upper structural channel and the beam are raised upwardly. The lower beam member may then be moved resulting in carrying of the expandable member and the upper beam member or unit supported, thereby, longitudinally through the furnace to thereby transport the load. After a movement, the expandable tube is deflated allowing the beams to move downwardly below the furnace surface and depositing of the members within the furnace. A hydraulic cylinder motor unit or the like is coupled to the outer end of the beam assembly for reciprocating movement of the total beam assembly including the expandable tube and the supporting channel section longitudinally for sequential stepped movement with a true rectangular movement.

The conveyor or walking beam unit forming a part of the conveyor apparatus may thus be installed directly into as a part of the superstructure of the heating chamber. Simple external seal means adjacent the walking beam structure may be employed for a totally sealed unit. The use of the expandable tube and the continuous flow of cooling medium provides a very simple and reliable means of controlling the positioning and simultaneously maintaining the effective cooling of the beam structure to thereby significantly increase the total life of the apparatus while minimizing the necessity for expensive high temperature materials. The rectangular movement of the beam further particularly adapts it to ready cleaning of the system. Thus, brushes or other scraper means can be attached to the beam or furnace side walls such that as it moves vertically and longitudinally throughout the unit, all of the extraneous materials may be transported longitudinally through the unit for convenient removal.

BRIEF DESCRIPTION OF THE DRAWINGS

The drawing furnished herewith illustrates a preferred construction of the present invention in which the above advantages and features are clearly disclosed, as well as others, which will be readily understood from the following description.

In the drawings.

DESCRIPTION OF ILLUSTRATED EMBODIMENT

Figure 1:
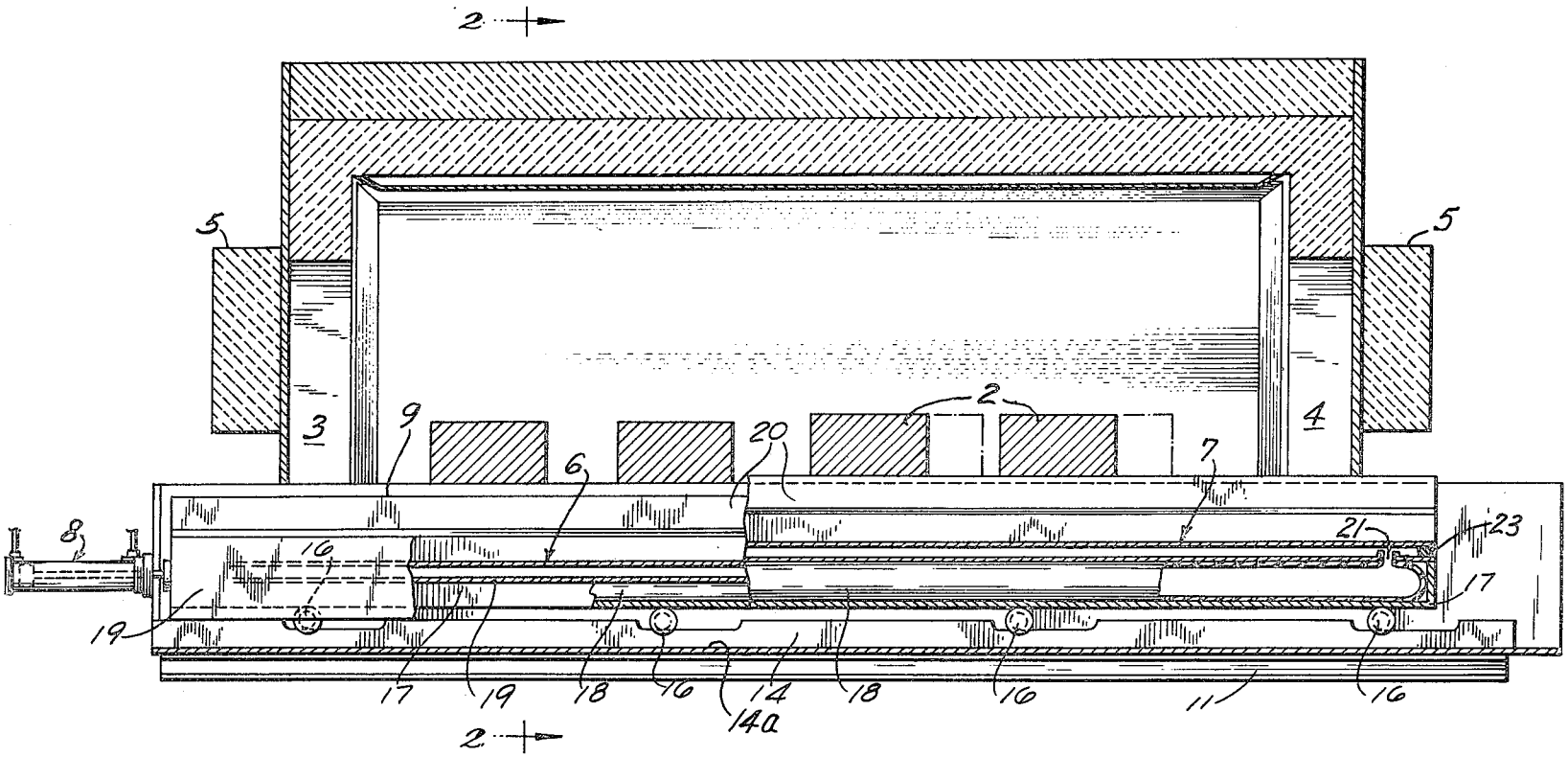
FIG. 1 is a view side view partly in section and partly in elevation and illustrating the self-contained, hydraulically actuated walking beam emboding the present invention.
Figure 2:
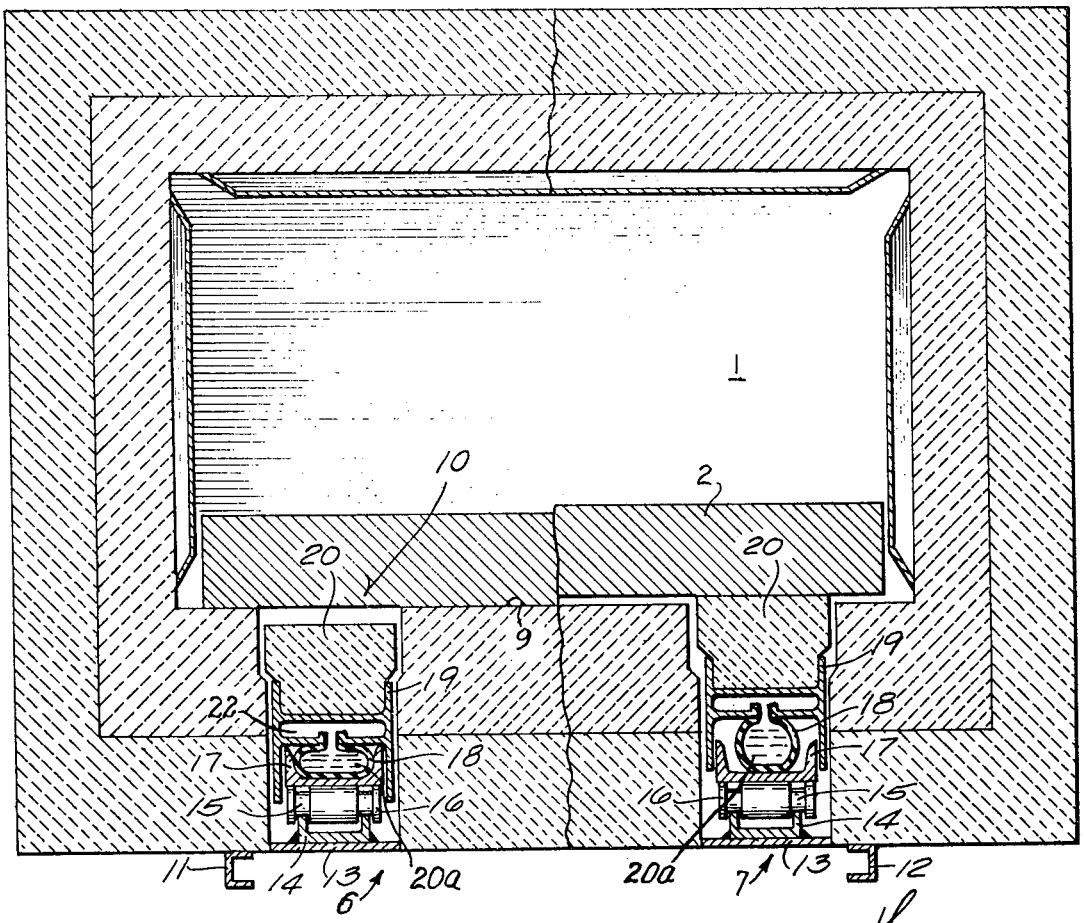
FIG. 2 is a vertical cross-sectional view taken generally on line 2—2 of FIG. 1.

Referring to the drawings and particularly to FIGS. 1 and 2, the present invention is illustrated in connection with a conventional high temperature furnace 1 having a suitable inner refractory wall. The furnace 1 is used for treating of suitable metal members 2 which are passed therethrough between an entrance opening 3 and a discharge opening 4. The openings are closed to any suitable outer closure means 5 shown by simple sliding door means of suitable high refractor material. Generally, the furnace may operate on the order of 1600° fahrenheit or higher and the chamber may be essentially a gas tight heating chamber or partially opening, as shown, depending upon the application. It is important to provide automated movement of the loads 2 through to the furnace 1. In the illustrated embodiment of the invention, a pair of corresponding walking beam units 6 and 7, constructed in accordance with the teaching of the present invention, are shown located within the base wall of the furnace. Each of the units 6 and 7 is similarly activated from a separate pneumatic cylinder operator 8, respectively, mounted to the one end of the corresponding unit exteriorly of the furnace 1 to permit the sequential continuous movement of the loads 2 within and through the furnace structure. Generally, as shown in the drawings and particularly FIGS. 1 and 2, the beam units 6 and 7 are adapted to raise loads 2 from the interior furnace floor 9 while moving thereof through the furnace to eliminate scrapping or rubbing friction therebetween and to thereafter deposit the load 2 upon the floor for heating.

As each of the walking beam units 6 and 7 is similarly constructed and located within an opening 10 in floor 9, the walking beam unit 6 will be particularly described in the lowered position and reference made to unit 7 to show the alternate raised position for transport of load 2.

The furnace structure is illustrated supported on a pair of suitable angle members 11 and 12 disposed in parallel relation beneath the furnace floor structure.

Figure 3:
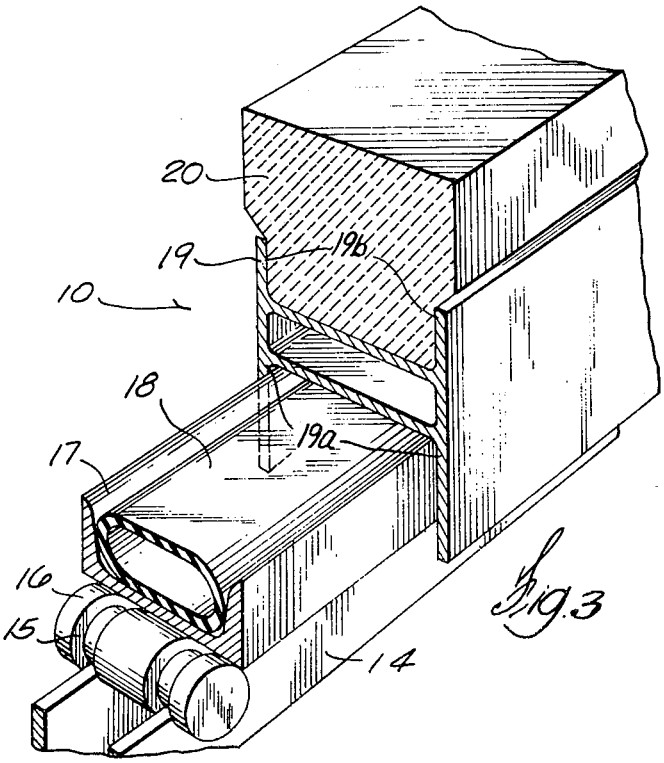
FIG. 3 is a fragmentary perspective view of a portion of the walking beam structure more clearly illustrating details of construction.

Referring to the drawings and particularly to FIGS. 1, 2 and 3, the walking beam unit 6 includes a bottom floor member 13 located within the bottom of the longitudinally extended conveying support wall opening 10 to close the lower end thereof. A supporting track 14 is secured upon the member 13 and, in the illustrated embodiment of the invention, includes an upwardly opening channel member have a pair of upper side walls having aligned edge recesses 14*a* spaced longitudinally of the walls and mating with correspondingly spaced annular slots 15 on a plurality of rollers 16. An upwardly opening U-shaped channel 17 has a planar bottom wall resting and riding on the top of the rollers 16. A single, flexible tube 18 is located within the recess defined by the channel 17 and extends throughout the length of the walking beam unit. A generally H-shaped channel carrier element 19 includes a downwardly opening channel section with opposed sidewalls 19*a* telescoped downwardly over the upwardly opening channel member 17 to thus define an enclosing chamber or opening within which the flexible tube 18 is confined. The element 19 further includes an upwardly opening channel portion defined by a pair of upwardly projecting sidearms or walls 19*b* which extend upwardly within the floor opening and terminate in downwardly spaced relation to the inner floor of the furnace. A work carrier 20, formed as an elongated beam element of a suitable high temperature refractory material such as that employed for the inner liner of the furnace, is supported within the upwardly opening portion and particularly between arms 19*b* of element 19. In the illustrated embodiment of the invention, the upper portion of the conveyor opening 10 is slightly laterally enlarged with respect to the opening containing the supporting metal beams structures. The carrier 20 is similarly shaped with slightly enlarged upper portion and a lower reduced portion mating with and located within the upwardly opening channel portion defined by the channel sides 19*b* to provide a firm support of the work carrier 20 for movement, as presently described. The upper enlarged portion further avoids a direct radiation path from the heating chamber to the lower section of the beam proper.

As shown to the left in FIGS. 1 and 2, the walking beam unit 6 is shown with the flexible tube 18 collapsed and with the generally H-shaped beam 19 having its central or cross portion resting on the upper edge of the upwardly opening channel 17. Thus, the total weight of assembly is transmitted downwardly through the roller structure to the supporting base.

To transport the loads 2, the flexible tube 18 is expanded by the introduction of a suitable hydraulic fluid 20*a* under the necessary pressure to expand the flexible tube 18, as shown to the right in FIGS. 1 and 2, for the expanded position of the walking beam unit 7. Once raised, the pneumatic units 8 are activated to extend the piston rod to move the total walking beam assembly on the rollers 16 and thereby move the loads 2 forwardly to the phantom of FIG. 1. When repositioned, as desired, the pressure on flexible tubes 18 is reduced allowing them to collapse to the position shown for walking beam units 6 in FIGS. 1 and 2. In this manner, the walking beam unit permits the sequential stepped movement of the loads 2 through the furnace 1. The walking beam units 6 and 7 with the expandable supports provides a highly improved and simplified structure which is readily adapted to external actuation and sealing of the chamber at the opposite ends. Thus, the sides and bottom of the longitudinal extended walking beam support openings can be readily sealed, and particular where opposite ends do extend through the furnace, simple sliding seals or other suitable enclosing means may be employed. Further, the total gaps between the several components is readily minimized as a result of the straight rectangular movement of the total assembly and the direct application of force from beneath the work carriers 20.

Figure 5:
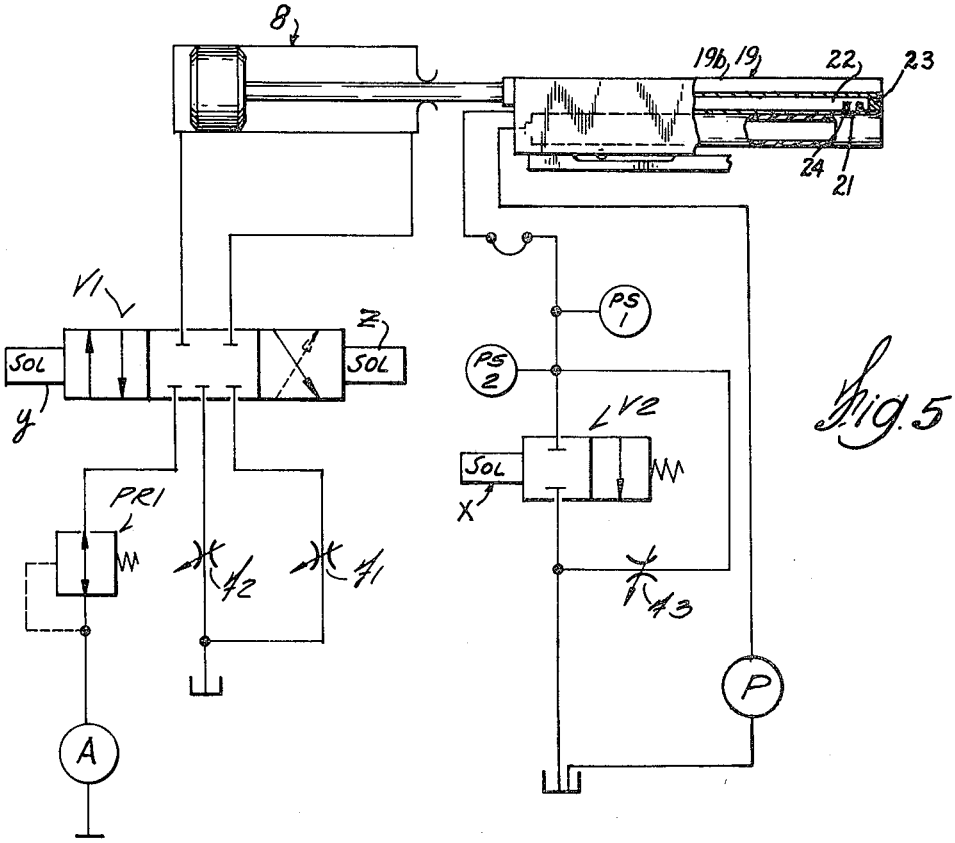
FIG. 5 is a typical flow diagram showing the interrelationship of the hydraulic lifting and positioning means forming a part of the walking beam shown in FIG. 1.

In addition, as previously noted, it is highly desirable to maintain complete effective cooling of the beam units 6 and 7 to further minimize the adverse affect on the structural components as a result of the high temperature conditions encountered. In accordance with a further aspect of the illustrated embodiment of the invention, the hydraulic medium 20*a* supplied to the flexible tube 18 is a suitable cooling medium such as water which forms a part of a continuous or other intermittent cooling flowing. Thus, in the illustrated embodiment of the invention as shown in FIGS. 1, 2 and 5, the tube 18 is connected to a pump P of suitable hydraulic cooling medium such as water adjacent to the entrance end. The opposite or innermost end of the tube 18 includes a coupling conduit 21 embedded therein similarly to a conventional automotive inner tube. The conduit 21 extends through an opening in the central wall of H-shaped channel 19 to a return channel or passageway 22 formed therein. Thus, in the illustrated embodiment of the invention, the central wall is defined by a pair of vertically spaced walls interconnected to the sidewalls 19*a* and 19*b* to form the cooling passageway. The end of the passageway adjacent to the closed end of the tube 18 is sealed by a releasable plug 23 or in any other suitable manner and coupled to the adjacent end of the tube 18 by the coupling conduit 21. The opening is conveniently sealed by a clamping nut 24 threaded on to the outer threaded portion of conduit 21. The opposite end of the passageway is coupled to a suitable sump 25 by a controlled flow path under the control of the solenoid valve V2 as shown in FIG. 5.

In the illustrated embodiment, pump P is a constant flow unit to circulate water or the like through the flexible tube 18 and the passageway 22 in series to maintain the cooling of the beam unit 6. In the illustrated embodiment of the invention, the exhaust solenoid valve V2 is either opened or closed and connects the discharge end of the passageway 22 to the sump. In parallel with the solenoid valve V2 is a restricted bypass including an adjustable restrictable valve F3 which may be manually adjustable and which is adapted to control the return flow to the sump. Thus, with the solenoid valve V2 in the closed position, the only flow is through the restricted passageway including the adjustable restrictor F3. The restricted flow results in an increase in the pressure developed within the flow passageway with a consequent increased pressure within the flexible tube 18. As the pressure rises, tube 18 expands raising the beam structure to the position shown for unit 7. When the valve V2 is opened, the pump continues to circulate water through the system. However, the pressure is significantly reduced as the result of the elimination of the restriction in the flow passageway. The flexible tube 18, therefore, collapses to the position shown for unit 6 while maintaining a continuing flow of collant through the system to maintain the desired highly effective cooling.

Referring particularly to FIG. 5, the pneumatic actuator 8 is diagramatically illustrated with the opposite end of the unit connected to a three-way valve unit V1. In the illustrated position, the opposite ends of the hydraulic cylinder unit are disconnected from the pneumatic pressure source A. Consequently, the cylinder is held in the fixed limit position. The valve V1 is shown with oppositely located operating solenoids for selectively moving of the valve to the right and to the left positions as viewed in FIG. 5. Moving of the valve unit to the right as viewed in FIG. 5 results in the supply of pressure to the left end of the hydraulic cylinder and exhausting of the right or opposite end, thereby permitting and effecting the forward movement of the beam unit as shown in FIGS. 1 and 5. This results in the forward stepping of the walking beam units. Similarly, operation of the opposite solenoid operator results in the reverse positioning or connection of the source A to the cylinder unit 8 to effect the reverse movement thereof.

In the illustrated embodiment of the invention, a pressure reducing regulating valve PR1 is shown between the source A and the valve V1 to provide a suitable reduction and regulation of the pressures applied to the cylinder to thereby control the movement. Similarly, the exhaust side of the cylinder connection of the valve V1 includes a pair of paralleled adjustable non-compensated flow control restrictors F1 and F2 connected between the sump and a pair of valve port connections. Thus, by appropriate energization of the valve, the particular rate of movement can be controlled during the forward and reverse movement of the unit.

As such valve structures are well known in the positioning art and can be readily provided by anyone skilled in the art. No further description thereof is given.

The operation of the conveyed system and the actuation of the tube may be interrelated in any suitable manner, for example, through the use of pressure responsive switches PS1 and PS2 responsive respectively to a selected low water pressure limit and a high pressure water limit in the return passageway of the flow system.

Figure 4:
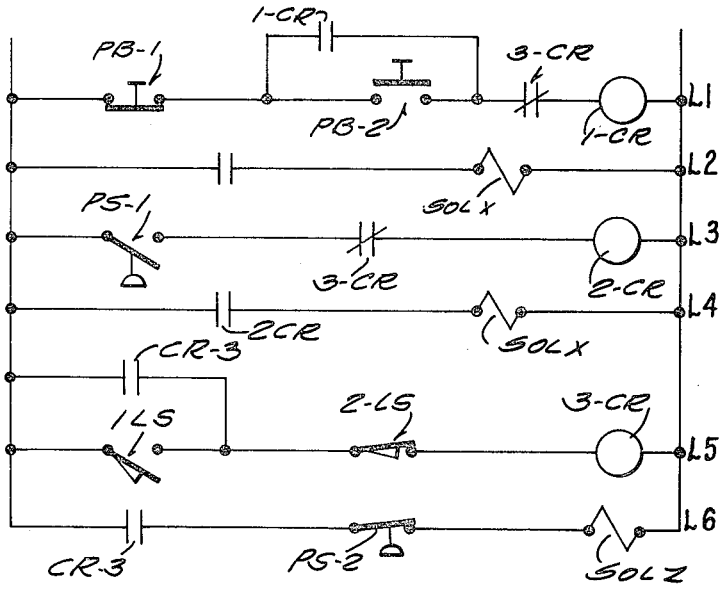
FIG. 4 is a typical wiring diagram illustrating a possible switching control.

Any suitable circuit can be employed to control the sequencing of the movement. A suitable circuit is shown in FIG. 4 incorporating the pressure limit switches PS1 and PS2 and the solenoid structure shown in FIG. 5. Generally, FIG. 4 is an across-the-line schematic diagram. The uppermost line includes a suitable push-button operator PB-1 of a normally closed construction for terminating the operation of the cycle. It is connected in a series with a normally open similar push-button start switch PB-2 and an interlock relay 1-CR having a set or normally open contacts 1-CR connected in parallel with push-button switch PB-2. Thus, when the switch PB-2 is actuated, the relay 1-CR will be energized, close its associated contacts and lock the circuit in through stop switch PB-1. The relay 1-CR further includes a second set of contacts in the second line L2 which are closed thereupon energization of the relay 1-CR. This completes energization of the solenoid X, which actuates the solenoid valve V2, causing the valve V2 to move to the closed position and resulting in the restricted flow through the system with the resulting expansion of the flexible tube 18. As the tube 18 rises, the pressure within the flexible tube correspondingly increases. The pressure switch PS1 closes at a selected level and completes a circuit to energize a relay to 2-CR which in turn closes its contacts 2-CR in line L4 and thereby energizing a solenoid Y which Y forms a part of the valve V1 and particularly moves the three-way valve to couple the pressure source A to the left side of the cylinder unit 8 to effect the forward movement of the walking beam unit. At a selected limit of desired forward movement, a limit switch LS in line L5 of FIG. 4 is actuated. The affects energization of a further control relay 3-CR in line L5, the energization of which simultaneously closes a set of normally open contacts 3-CR in line L6 to energize a solenoid Z connected to the opposite end of the valve V1. Its energization is not established immediately as a result of the interconnection, which of course opened as the pressure rose, of a low pressure switch PS-2 in series with the solenoid valve Z and the relay contacts CR-3 in line L6. As shown, the switch PS-2 is a time delay switch and consequently the pressure must reduce below its set level for a predetermined time before the switch will complete its closure movement.

The energized relay 3-CR simultaneously activates a set of interlock contacts 3-CR connected in parallel with the limit switch 1-LS in line L5. Consequently, the momentary closure of the limit switch locked in the energization of the relay 3-CR as the operator unit 8 moves to the retracted position.

The relay 3-CR controls a third and fourth set of normally closed contacts connected respectively in lines L1 and L3 to provide an interlock to the raising relay 1-CR and the forward movement relay 2-CR. These contacts open upon energization of the relay 3-CR and, thereby, release relays 1-CR which, when dropping out, deenergizes solenoid X of valve V2 which resets to the low pressure condition. This results in the reduction in the pressure within the flexible tube 18 with a consequent lowering or collapse of the tube and a corresponding lowering of the raised beam unit to the position of unit 6.

The opening of the contacts 3-CR in line L3 and the release of the relay 2-CR deenergizes the solenoid Y thereby permitting the rest of the solenoid valve V1 to the central position. As the pressure drops, it will drop below the opening pressure of PS2 and after a predetermined time delay PS2 will close. Solenoid Z will then energize and actuate the four-way, three position valve V1 to move to the opposite or the reset position, thereby, connecting the output of the pressure source A to the right end of the cylinder unit 8, as shown in FIG. 5. The cylinder unit 8 will retract, returning the lowered beam units 6 and 7 to the initial starting position at which point it will open limit switch 2-LS in line L5 breaking the circuit to 3-CR and resetting of the circuit to the standby position.

In this way the operator can manually control the selective stepped movement of the loads 2 through the oven structure.

Although shown as a single expandable member, obviously a plurality of expandable members could be employed connecting in series or parallel to one or more pressurized sources which in an optimum construction would provide for a return circulation within the beam structure.

Thus, in the illustrated embodiment of the invention, the walking beam unit forms a part of the load conveying apparatus and is mounted directly within the base or floor structure. The upwardly, expandable means located beneath the beam and the support for expansion and contraction creates a simple, reliable lift and support means. The combined novel cooling passage system providing for the combined cooling and positioning provides a highly improved and simplified structure uniquely adapted to practical implementation in various furnace structures.

Various modes of carrying out the invention are contemplated as being within the scope of the following claims, particularly pointing out and distinctly claiming the subject matter which is regarded as the invention:

I claim:

1. A walking beam unit for high temperature conveying apparatus, comprising a base wall for a high temperature furnace and having a longitudinal opening, an elongated beam means extended through the conveying apparatus within said opening, a longitudinal moving support means located within said base wall and beneath the beam means, an upwardly expandable means located within said base wall opening and between the beam means and the support means in spaced relation to the ends of the base wall and including a vertically moving portion and an internal fluid medium for exerting a vertical fluid pressure on said portion, said expandable means being located beneath the beam means and collapsible to hold the beam means below the base wall and operable to exert a lifting force on said vertically moving portion to raise the beam vertically above the base wall, and means coupled to the support means for longitudinally moving of the beam means.

2. The apparatus of claim 1 wherein the expandable means is an elongated flexible tube means having an outer flexible sidewall and extending longitudinally and beneath the beam means, source means connected to supply fluid to the tube means to enlarge the tube means for raising the beam means.

3. The apparatus of claim 2 wherein the tube means is located within a bottom channel of the support means and an inverted channel member rests on said flexible tube means, said beam means being connected to said inverted channel member.

4. The apparatus of claim 3 wherein said support means includes a plurality of longitudinally spaced supporting rollers beneath said support channel means.

5. The beam unit of claim 1 wherein said expandable means defines a longitudinally extended cooling passageway beneath said beam means, and flow means establishing a flow of a cooling fluid through the passageway, said flow means being adjustable to vary the pressure of the cooling media to selectively expand the expandable means.

6. A walking beam unit for high temperature furnaces, comprising a beam extended through the furnace, an elongated flexible tube extended essentially completely beneath the beam to provide vertical movement and encased between a lower stationary metal channel section that supports the beam proper and extending the length of the beam, that when in a semi-relaxed condition, allows the beam to rest on the upward extending flanges of a vertically stationary channel section which can be considered the beam's lowered position, a continuous flow means connected to the tube and supplying cooling media to the tube, discharge control means including a partial restricting means to adjustably limit the flow of cooling media at the discharge point resulting in a pressure build-up within the tube with the resulting expansion of the tube to lift the beam to provide vertical movement, movable support means coupled to the beam and tube for simultaneous, longitudinal, reciprocating movement of the beam.

7. The walking beam unit of claim 6 wherein the flexible tube is a continuous elongated tubular member establishing simultaneously the same pressure throughout the length of the beam.

8. A walking beam unit of claim 6 including a fixed cooling passageway in the underside of the beam means, and means coupling the discharge end of the flexible tube to said cooling passageway.

9. The walking beam unit of claim 8 wherein said beam includes an upper supporting refractory body and a bottom supporting metal plate, said plate resting on said flexible tube and being formed with said passageway.

10. The walking beam unit of claim 9 including an adjustable flow restricting means connected to the discharge end of the cooling passageway for varying of the back pressure and thereby controlling the expansion and collapse of said flexible tube.

11. The walking beam of claim 10 having a rolling channel located beneath the tube with sidewalls projecting upwardly to opposite sides of the tube, said support plate member is an H-shaped channel having sidewalls projecting upwardly to the opposite sides of the refractory body and downwardly over the sidewalls of rolling channel and having an intermediate connecting wall resting and overlying the rolling channel.

* * * * *